US008210868B1

(12) United States Patent
Robling et al.

(10) Patent No.: US 8,210,868 B1
(45) Date of Patent: Jul. 3, 2012

(54) DAISY CHAIN CABLE

(76) Inventors: Jason O. Robling, Frederick, MD (US); Michael B. Milbert, Darnestown, MD (US); Charles Huisentruit, Silver Spring, MD (US)

( * ) Notice: Subject to any disclaimer, the term of this patent is extended or adjusted under 35 U.S.C. 154(b) by 180 days.

(21) Appl. No.: 12/798,310

(22) Filed: Apr. 1, 2010

Related U.S. Application Data

(60) Provisional application No. 61/211,758, filed on Apr. 2, 2009.

(51) Int. Cl.
*H01R 11/00* (2006.01)

(52) U.S. Cl. ..... 439/502

(58) Field of Classification Search ..... 439/502, 439/505, 284, 290, 291, 578, 579, 623, 498, 439/583

See application file for complete search history.

(56) References Cited

U.S. PATENT DOCUMENTS 4,026,621 A * 5/1977 Korba ..... 439/125
5,030,122 A * 7/1991 Birch et al. ..... 439/188
5,702,261 A * 12/1997 Wang ..... 439/188
5,882,228 A * 3/1999 Kobler ..... 439/620.05

OTHER PUBLICATIONS

Anon: Hosa PWD-400 Multi-head Power Cord; American Musical Supply commercial web site: www.americanmusical.com/Item-I-HOS-PWD401-LIST; Retrieved Oct. 6, 2010.

* cited by examiner

*Primary Examiner* — Edwin A. Leon
(74) *Attorney, Agent, or Firm* — James Creighton Wray

(57) ABSTRACT

Segmental daisy chain power connectors for electric powered musical equipment have short two wire insulated power cords with first and second push-in barrel or telephone-type male connectors at first and second ends and push-in barrel or telephone-type female receivers at second ends. The receivers are axially aligned with or perpendicular to the second push-in male connectors at the second ends of the power cords. The push-in connectors have internal insulated connectors for connecting to pins in receivers in the cords and in receiver power connections in the musical equipment.

15 Claims, 1 Drawing Sheet

DAISY CHAIN CABLE

This application claims the benefit of U.S. Provisional Application No. 61/211,758, filed Apr. 2, 2009, which is hereby incorporated by reference in its entirety.

SUMMARY OF THE INVENTION

Many musicians use a DC "daisy-chain" cable to power multiple effects pedals from one power source. Those are convenient because the DC power can be delivered to each pedal in parallel through a single 2-conductor wire, with standard mini-barrel or mini-phone-plug type connectors at various points along the wire. These are inconvenient because the "extra" connectors, i.e. the ones that are not used, can be messy and also have to be insulated either with electrical tape or rubber caps so that they do not short out accidentally.

The invention employs the use of a 'segmented' daisy chain system that allows musicians to use only the number of connectors that they need, as each segment can plug into another segment. The segments could also be a varying length and employ different connector-ends, depending on the musicians' requirements. This system would also allow a musician to replace only the damaged section of a daisy-chain, instead of the whole cable.

These and further and other objects and features of the invention are apparent in the disclosure, which include the above and ongoing written specification, with the claims and the drawings.

DETAILED DESCRIPTION OF THE DRAWINGS

Figure 1:
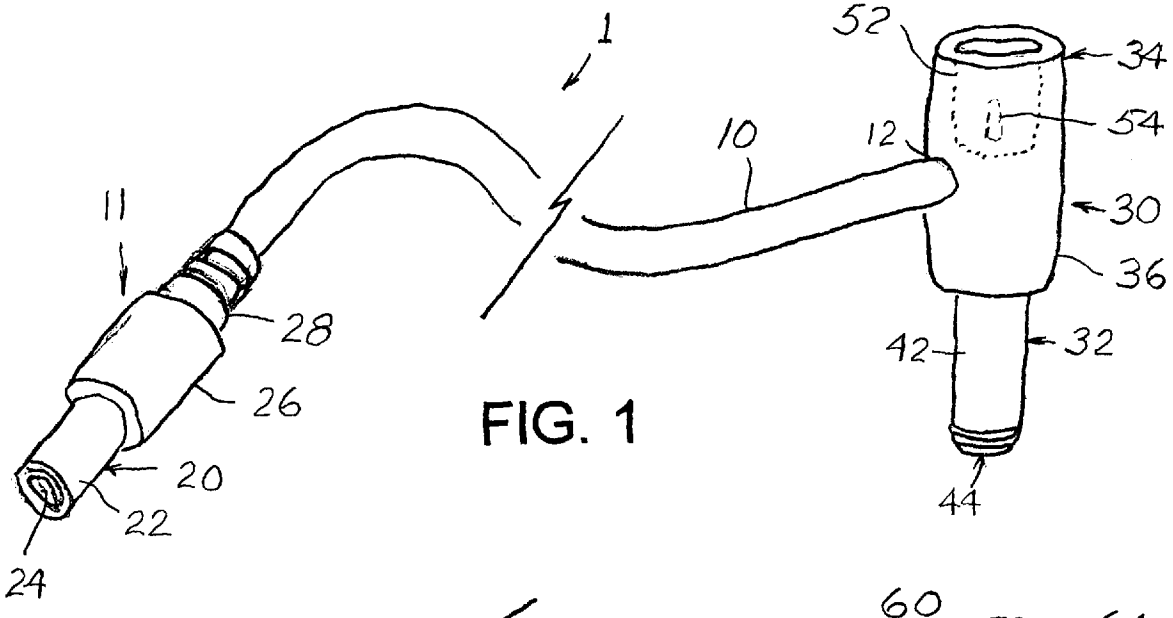
FIG. 1 is a perspective view of a new segmented daisy chain connector with an axially configured output barrel connector and jack.

As shown in FIG. 1, a segmented daisy chain DC power connector 1 has a two wire power cord 10 with first and second ends 11, 12. A male power connector barrel 20 fits in a power output connector socket on a power source. The metal exterior 22 of the barrel 20 and the conductive interior 24 of barrel 20 are separated by an insulator. The conductive exterior 22 and interior 24 of barrel 20 are connected to a sleeve and pin in a low power DC output socket of a power supply box. The sleeve internal connector and a central pin exterior connector are connected to positive and negative outputs of the AC to low power DC power supply.

The sleeve and pin connectors in the power supply respectively contact and complete electrical connections to the barrel metal exterior 22 and metal interior 24.

The connector barrel 20 has a rubber grip 26 for holding when inserting or extracting the connector barrel 20 into or from the power supply output socket. An open flexible cylindrical collar 28 radiuses any bending of the cable 10 at the grip 26 to prevent fraying or breaking the insulative cover or the interior wires on the first end 11 of the power cord 10.

The second end 12 of the two wire power cord 10 is connected to a power output connector 30. Output connector 30 has a coaxially connected output connector barrel 32 and jack 34 held by a rubber insulator cylinder 36 which is connected perpendicularly to the second end 12 of cable 10.

The output connector barrel 32 is constructed similarly to the male power connector barrel 20 with a conductive exterior 42 and a conductive cylindrical interior 44. The output barrel fits into an input power receptacle in an electronic music device, for example, a sound altering pedal, widely used by guitar players. The low power DC receptacle of the pedal has a sleeve which makes a first contact with the conductive exterior 42 of power output barrel 32. A conductive pin within the receptacle makes electrical contact with the conductive cylindrical metal interior 44 of power output barrel 32.

Jack 34 is connected to the rubber insulator cylinder 36 and provides an output connection for the next similar connector 1 to power the next pedal.

Jack 34 has a conductive cylindrical sleeve 52 and a conductive pin 54 which are ready to receive an input connector barrel 20 of another DC power connector 1.

The cylindrical conductive sleeve 52 and the central conductive pin 54 are similar to the sleeve and pin in the low power DC power supply.

Figure 2:
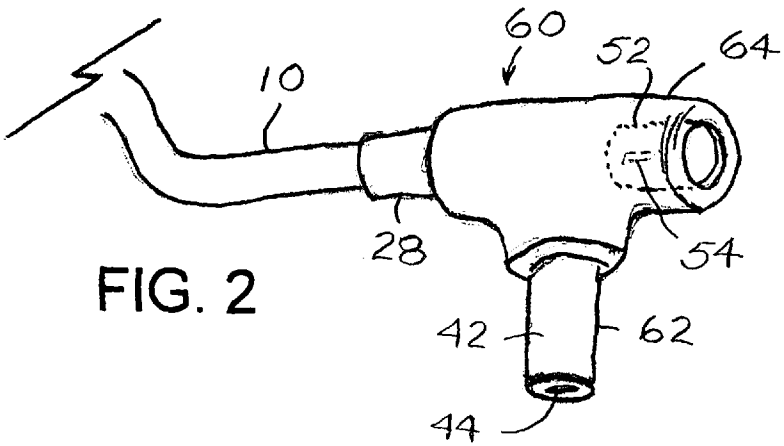
FIG. 2 is a detail of a T-shape output connector with a perpendicular output barrel connector and jack.

As shown in FIG. 2 the coaxial connector 30 with the coaxial barrel 32 and jack 34 is replaced by a T-shaped right angle connector 60 with an output barrel 62 and jack 64. The output barrel 62 is at a right angle with the power cord 10, and the jack is coaxial with the power cord 10. The output barrel 62 is constructed similarly to the output barrel 32 and the output jack 64 is constructed similarly to the output jack 34.

The new segmented daisy chain elements provide neat connection between adjacent pedals and eliminate extra wires and exposed connectors which might be distractive to a musician and audience and which may add dangers of tripping, short circuiting or heating.

While the invention has been described with reference to specific embodiments, modifications and variations of the invention may be constructed without departing from the scope of the invention, which is defined in the following claims.

We claim:

1. Apparatus comprising:

a power connector for connecting powered music effect pedals further comprising a two wire insulated power cord having first and second insulated electric power wires, the two wire insulated power cord having first and second ends, the first end having a first barrel connector connected to the first and second insulated electric power wires in the insulated cord, a first rubber grip at least partially covering the first barrel connector for a user to grasp when inserting the first barrel connector in or removing the connector from a power output socket in an electronic music device, the first barrel connector having a male metal barrel exterior connected to the first end of the first insulated wire and a hollow internal metal sleeve within the metal barrel and insulated from the metal barrel exterior, the metal sleeve connected to the first end of the second insulated electric power wire in the insulated power cord, the second end having a second barrel connector connected to the second ends of the first and second insulated electric power wires in the insulated cord, a second rubber grip second barrel connector for a user to grasp when inserting the second barrel connector in or removing the connector from a power input socket, the second barrel connector having a second male metal barrel exterior connected to the second end of the first insulated wire and a second hollow internal metal sleeve within the second metal barrel and insulated from the second metal barrel exterior connected to the second end of the second insulated electric power wire in the insulated power cord, the second end also having a cylindrical power output socket within the second rubber grip, the cylindrical power output socket having a large cylindrical internal metal sleeve connected to the second end of the first insulated wire and a metal pin concentric within and insulated from the large cylindrical internal metal sleeve, the metal pin being connected to the second end of the second insulated wire for receiving a male barrel exterior another connector in the metal sleeve.

2. The apparatus of claim 1, wherein the second connector and the power output socket are coaxial.

3. The apparatus of claim 2, wherein the second rubber grip is cylindrical.

4. The apparatus of claim 1, wherein the second connector and the power output socket are perpendicular.

5. The apparatus of claim 4, wherein the second rubber grip is T-shaped.

6. Apparatus comprising:

a power connector for connecting powered music effect pedals further comprising a two wire insulated power cord having first and second insulated electric power wires, the two wire insulated power cord having first and second ends, the first end having a first connector connected to the first and second insulated electric power wires in the insulated cord, a first rubber grip at least partially covering the first connector for a user to grasp when inserting the first connector in or removing the connector from a power output socket in an electronic music device, the first connector having a male metal exterior connected to the first end of the first insulated wire and a hollow internal metal sleeve within the metal and insulated from the metal exterior, the metal sleeve connected to the first end of the second insulated electric power wire in the insulated power cord, the second end having a second connector connected to the second ends of the first and second insulated electric power wires in the insulated cord, a second rubber grip second connector for a user to grasp when inserting the second connector in or removing the connector from a power input socket, the second connector having a second male metal exterior connected to the second end of the first insulated wire and a second hollow internal metal sleeve within the second metal and insulated from the second metal exterior connected to the second end of the second insulated electric power wire in the insulated power cord, the second end also having a cylindrical power output socket within the second rubber grip, the cylindrical power output socket having a large cylindrical internal metal sleeve connected to the second end of the first insulated wire and a metal pin concentric within and insulated from the large cylindrical internal metal sleeve, the metal pin being connected to the second end of the second insulated wire for receiving a male barrel exterior another connector in the metal sleeve.

7. The apparatus of claim 6, wherein the second connector and the power output socket are coaxial.

8. The apparatus of claim 7, wherein the second rubber grip is cylindrical.

9. The apparatus of claim 6, wherein the second connector and the power output socket are perpendicular.

10. The apparatus of claim 9, wherein the second rubber grip is T-shaped.

11. Apparatus comprising:

a power push-in connector for connecting powered music effect pedals further comprising a two wire insulated power cord having first and second insulated electric power wires, the two wire insulated power cord having first and second ends, the first end having a first push-in connector connected to the first and second insulated electric power wires in the insulated cord, a first rubber grip at least partially covering the first push-in connector for a user to grasp when inserting the first push-in connector in or removing the push-in connector from a power output socket in an electronic music device, the first push-in connector having a male metal exterior connected to the first end of the first insulated wire and a hollow internal metal sleeve within the metal and insulated from the metal exterior, the metal sleeve connected to the first end of the second insulated electric power wire in the insulated power cord, the second end having a second push-in connector connected to the second ends of the first and second insulated electric power wires in the insulated cord, a second rubber grip second push-in connector for a user to grasp when inserting the second push-in connector in or removing the push-in connector from a power input socket, the second push-in connector having a second male metal exterior connected to the second end of the first insulated wire and a second hollow internal metal sleeve within the second metal and insulated from the second metal exterior connected to the second end of the second insulated electric power wire in the insulated power cord, the second end also having a cylindrical power output socket within the second rubber grip, the cylindrical power output socket having a large cylindrical internal metal sleeve connected to the second end of the first insulated wire and a metal pin concentric within and insulated from the large cylindrical internal metal sleeve, the metal pin being connected to the second end of the second insulated wire for receiving a male barrel exterior another push-in connector in the metal sleeve.

12. The apparatus of claim 11, wherein the second connector and the power output socket are coaxial.

13. The apparatus of claim 12, wherein the second rubber grip is cylindrical.

14. The apparatus of claim 11, wherein the second connector and the power output socket are perpendicular.

15. The apparatus of claim 14, wherein the second rubber grip is T-shaped.

* * * * *